US006543576B1

(12) United States Patent
Cofer et al.

(10) Patent No.: US 6,543,576 B1
(45) Date of Patent: Apr. 8, 2003

(54) MULTIPLE LAYER FIBER FILLED SOUND ABSORBER AND A METHOD OF MANUFACTURING THE SAME

(75) Inventors: Cameron Gorrell Cofer, Gahanna, OH (US); Goran Knut Knutsson, Falkenberg (SE); Kunio Komori, Okazaki (JP); Yukihito Sakai, Okazaki (JP)

(73) Assignees: Owens-Corning Fiberglas Technology, Inc., Summit, IL (US); Owens-Corning Sweden AB, Falkenburg (SE); Futaba Industrial Company, Ltd., Shi-Aichi (JP)

( * ) Notice: Subject to any disclaimer, the term of this patent is extended or adjusted under 35 U.S.C. 154(b) by 12 days.

(21) Appl. No.: 09/620,279

(22) Filed: Jul. 18, 2000

(51) Int. Cl.[7] ..... F01N 1/10
(52) U.S. Cl. ..... 181/252; 181/256
(58) Field of Search ..... 181/252, 256, 181/258, 282; 29/890.08

(56) References Cited

U.S. PATENT DOCUMENTS

| | | | | |
|---|---|---|---|---|
| 3,955,643 A | * | 5/1976 | Clark | 181/248 |
| 4,263,982 A | | 4/1981 | Feuling | |
| 4,269,800 A | | 5/1981 | Sommer et al. | |
| 4,371,054 A | | 2/1983 | Wirt | |
| 4,569,471 A | | 2/1986 | Ingemansson et al. | |
| 4,774,985 A | | 10/1988 | Broadbelt et al. | |
| 5,461,777 A | | 10/1995 | Ikeda et al. | |
| 5,479,706 A | | 1/1996 | Tamano et al. | |
| 5,926,954 A | | 7/1999 | Wolf et al. | |
| 6,009,705 A | * | 1/2000 | Arnott et al. | 123/184.57 |
| 6,053,276 A | * | 4/2000 | D'Amico et al. | 141/12 |
| 6,148,955 A | * | 11/2000 | Wolf et al. | 181/252 |
| 6,202,785 B1 | * | 3/2001 | Hilling et al. | 181/230 |
| 6,317,959 B1 | * | 11/2001 | Nilsson et al. | 29/455.1 |

FOREIGN PATENT DOCUMENTS

| | | |
|---|---|---|
| DE | 26 49 979 A1 | 5/1978 |
| EP | 0 926 320 A2 | 6/1999 |
| JP | 2000 110544 A | 4/2000 |

* cited by examiner

*Primary Examiner*—Kim Lockett
(74) *Attorney, Agent, or Firm*—Inger H. Eckert; Stephen W. Barns; Maria C. Casaway

(57) ABSTRACT

A multiple layer fiber filled sound absorber and method of manufacturing the absorber are disclosed. The sound absorber includes an outer housing, a porous or perforated inner tube or housing defining a passageway through which a gas may flow, and two layers of sound absorbing material, such as fiberglass wool, is positioned between the housings. The sound absorbing material adjacent the inner housing is selected to be more heat resistant than the material farther away from the inner housing. The sound absorber is filled with the sound absorbing materials using a direct fill process in which continuous fibers are injected into the sound absorber. In preparation for filling, a partition is positioned between the housings to define two chambers. Each chamber is filled with one of the sound absorbing materials. The partition may then be removed from the sound absorber, or may be left in place (in which case the partition is preferably porous or perforated). The two sound absorbing materials may be filled to different densities. If the partition is removed, the densities will tend to equalize. The direct fill process simplifies and reduces the cost of filling the container and provides a muffler that is uniformly filled and has an improved sound absorbing quality.

18 Claims, 5 Drawing Sheets

MULTIPLE LAYER FIBER FILLED SOUND ABSORBER AND A METHOD OF MANUFACTURING THE SAME

TECHNICAL FIELD AND INDUSTRIAL APPLICABILITY OF THE INVENTION

This invention relates generally to a sound absorber with multiple layers of sound absorbing material and a method of manufacturing a sound absorber, and in particular, to a method of directly filling a sound absorber with different types of sound absorbing material. The invention is useful in the production of sound absorbers that may be used to reduce noise emissions of a vehicle.

BACKGROUND OF THE INVENTION

Sound absorbers are typically used to reduce noise emissions and have numerous applications, for example, a muffler for a vehicle. A conventional sound absorber includes a housing or container, usually cylindrical or oval cross-section, with a perforated or porous inner tube extending through the end pieces of the container through which a gas, such as exhaust gas from an internal combustion engine, can flow. The sound absorber often includes a sound absorbing material, such as fiberglass wool, that is disposed between the housing and the inner tube and that dampens or attenuates noise in the gas flowing through the muffler.

Such mufflers may be manufactured in several ways. The fiberglass wool may be pressed in the form of a mat between the housing and the inner tube or rolled around the inner tube. U.S. Pat. No. 5,926,954 to Wolf ("Wolf") relates to a method of making a multiple fiber layer muffler. The layers of fiber yam are wrapped around an inner perforated tube as the tube rotates. A septum is placed between the layers to separate them from each other. The multiple layers and septums reduce blowout of the fibers (which decreases the acoustic reducing properties of the muffler). A drawback of the method of Wolf is that it requires the sound absorbing material to be in the form of a mat, thereby limiting its acoustic and thermal performance. The nature of the winding process results in parallel filaments that limit the thermal insulation properties of the fibrous material. Because of the required tension of the winding process, such fibers tend to be tightly packed against the perforated tube and equilibrate to the high temperatures of the exhaust gas resulting in a greater susceptibility to blowout. Also, the method is time consuming and expensive, and it requires multiple pieces of machinery.

Alternatively, the fiberglass wool may be in the form of expanded, chopped fiberglass with a fiber length of approximately 50 mm. Using such chopped strand fiberglass requires expensive equipment for filling the mufflers and makes it difficult to fill the muffler evenly. Both the chopping and needling processes impart severe damage to the fibers with a loss of more than 50% of the fibers' tensile strength. Additionally, such a construction exhibits poor durability since a majority of the chopped fibers are often less than 15 mm in length. These very short fibers eventually migrate through the muffler perforations and blow out. Uneven filling can also result in the wool being packed against the cylindrical inner wall of the housing by the exhaust gases passing through the inner tube, which in turn leads to the noise reducing performance of the muffler deteriorating relatively quickly. This process has high fabrication costs due to the amount of labor, number of preparation steps, waste, and difficulties in filling complex designs.

One design consideration for sound absorbers is the thermal degradation of the sound absorbing materials over time from exposure to hot exhaust gases. One design approach involves the use of more temperature resistant materials near the inner tube of the muffler, where the temperatures are higher. U.S. Pat. No. 4,269,800 to Sommer et al. ("Sommer") discloses muffler designs that use both individual mats of mineral fibers and metal fibers and a composite mat consisting of both types of fibers. Sommer discloses a muffler with separate layers of mineral and metal fibers. The metal fiber is positioned closer to the combustion gas in the muffler than the mineral layer to provide heat and corrosion resistance protection. The two layers are needled or sewn together, or coupled with an adhesive. Sommer also discloses a method of manufacturing a composite mat by combining metal fibers with mineral fibers during the manufacture of a mineral fiber mat. It is time consuming and labor intensive to manufacture and insert the mat. Furthermore, the Sommer design offers only an incremental improvement in durability versus standard glass fiber mats. The design consists of discontinuous fibers which, under vibrational loading in the exhaust, will eventually migrate through the perforations and blow out of the muffler.

A need exists for an inexpensive way to manufacture a sound absorber that includes different types of sound absorbing fibers. The absorber would preferably contain continuous fibers which will not be predisposed to blow out of the muffler through perforations in the inner tube. By using different types of fibers, more expensive, temperature resistant fibers may be placed closer to the exhaust gas to protect the inexpensive fibers that are less resistant to heat.

SUMMARY OF THE INVENTION

The shortcomings of the prior art are overcome by the disclosed multiple layer fiber filled sound absorber and method of manufacturing the absorber. The sound absorber includes an outer housing, a porous or perforated inner tube or housing defining a passageway through which a gas may flow, and two layers of sound absorbing material, such as fiberglass wool, is positioned between the housings. The sound absorbing material adjacent the inner housing is selected to be more heat resistant than the material farther away from the inner housing.

The sound absorber is filled with the sound absorbing materials using a direct fill process in which continuous fibers are injected into the sound absorber. In preparation for filling, a partition is positioned between the housings to define two chambers. Each chamber is filled with one of the sound absorbing materials. The partition may then be removed from the sound absorber, or may be left in place (in which case the partition is preferably porous or perforated). The two sound absorbing materials may be filled to different densities. If the partition is removed, the densities will tend to equalize.

The direct fill process simplifies and reduces the cost of filling the container and provides a muffler that is uniformly filled and has an improved sound absorbing quality.

DETAILED DESCRIPTION AND PREFERRED EMBODIMENTS OF THE INVENTION

Figure 1:
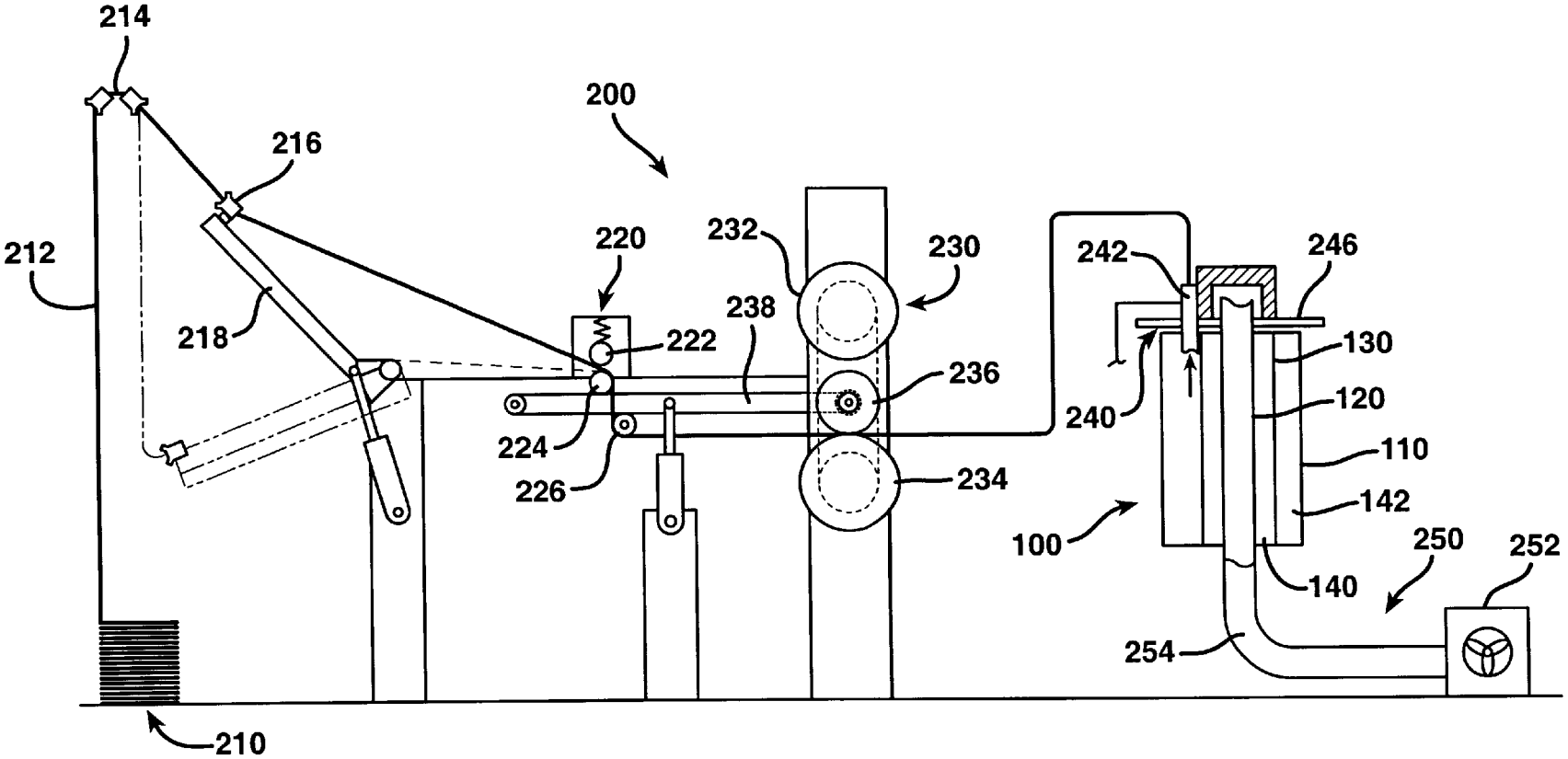
FIG. 1 is a schematic side view of a sound absorber and a direct fill apparatus for filling the sound absorber in accordance with the principles of the invention.

A multiple layer sound absorber and a method of manufacturing a sound absorber embodying the principles of the invention are illustrated in FIGS. 1–6B. The disclosed sound absorber provides good acoustic absorbing characteristics at relatively low manufacturing cost. The disclosed method of manufacturing a sound absorber improves the process of filling the absorber, particularly by easily supplying strands of different sound absorbing materials into the device.

The sound absorber of the invention includes a housing, a passage disposed in the housing through which gas may flow that has acoustic noise to be attenuated by the absorber, and sound absorbing material disposed in the housing to attenuate acoustic noise emanating from the gas flow in the passage. The sound absorbing material includes two or more compositions of differing properties, such as thermal or acoustic properties. A first sound absorbing material is disposed adjacent the passage and the gas flow through the passage. The first material has a property with a selected value, such a sea relatively high resistance to thermal degradation from the hot gas flowing through the passage. Acoustic noise is attenuated in the first material. The first material is also a thermal insulator, providing a gradient in temperature through the first material from the surface of the first material that is adjacent the hot gas flow through the passage. A second material is disposed adjacent the first material to provide further acoustic attenuation. The second material preferably has a different selected value for the property of interest, such as a lower resistance to thermal degradation, than the first material. The thicknesses and thermal properties of the first and second materials are selected so that the temperature drop between the surface of the first material adjacent the hot gas flow and the interface between the first and second materials is such that the temperature at the interface does not produce unacceptable thermal degradation of the second material. The total thickness and the sound attenuation properties of the two materials are selected to provide the desired sound absorbing performance for the sound absorber.

The sound absorbing materials are preferably continuous glass filaments, and are preferably injected into the housing into the desired locations for the materials. A partition may be disposed within the housing to separate the two materials as they are injected into the housing and thereby define the regions to be filled by the two materials. The partition may be removed from the housing after filling, or may be left in place to form a part of the sound absorber.

The geometry and orientation of the two materials, the housing, and the flow passage can vary widely according to the design of the sound absorber. In a conventional muffler design, as described in more detail below, the flow passage, the two materials, and the housing can be arranged as concentric circular cylinders. Many other shapes with constant or varying cross-sections could also be used. Depending on the temperature profile along the axis of the gas passage and the temperature profile through the thickness of the sound absorbing materials, the sound absorbing materials may also be arranged within the housing with varying thicknesses, including zero thickness for the first material at some axial locations.

The two materials may also be injected into the housing to different fill densities. These densities may be maintained in the finished sound absorber by the presence of the partition, or in the embodiment in which the partition is removed the densities may shift to an equilibrium in which the material filled to a higher density expands to a lower density and compresses the other material to a higher density.

With these general principles identified selected implementations of these principles in currently preferred embodiments are set forth below.

Figure 2:
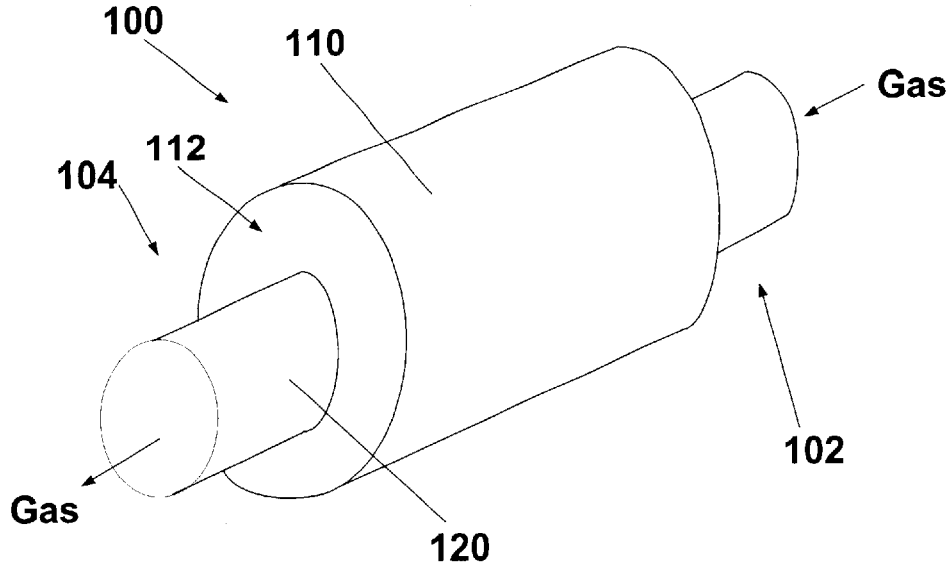
FIG. 2 is an isometric view of a sound absorber embodying the principles of the invention.

A sound absorber embodying the principles of the invention is shown in FIGS. 2–6B. As shown in FIG. 2 sound absorber 100 includes a generally cylindrical outer housing 110 and a generally cylindrical, concentrically disposed inner housing 120 extending through the outer housing. The inner housing 120 defines a passageway 126 through which the gas flows, with an inlet end 102 into which the gas with acoustic noise content is introduced and an outlet end 104 from which the gas exits.

Figure 3:
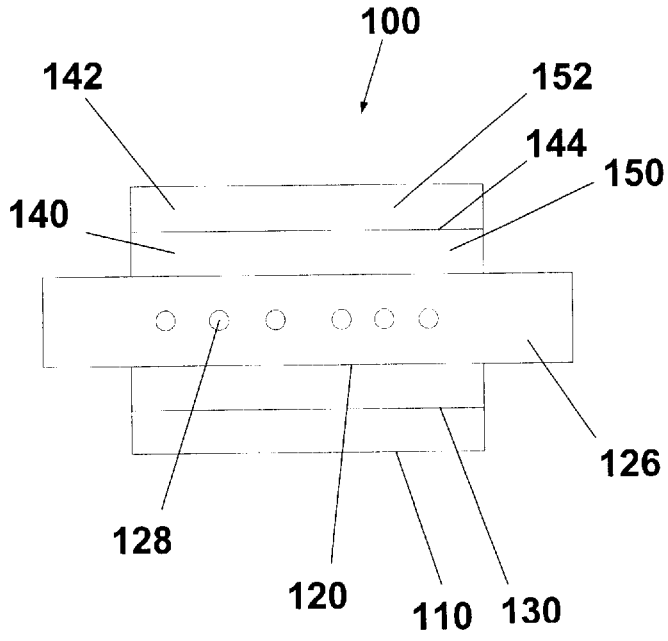
FIG. 3 is a cross-sectional side view of the sound absorber of FIG. 2.
Figure 4:
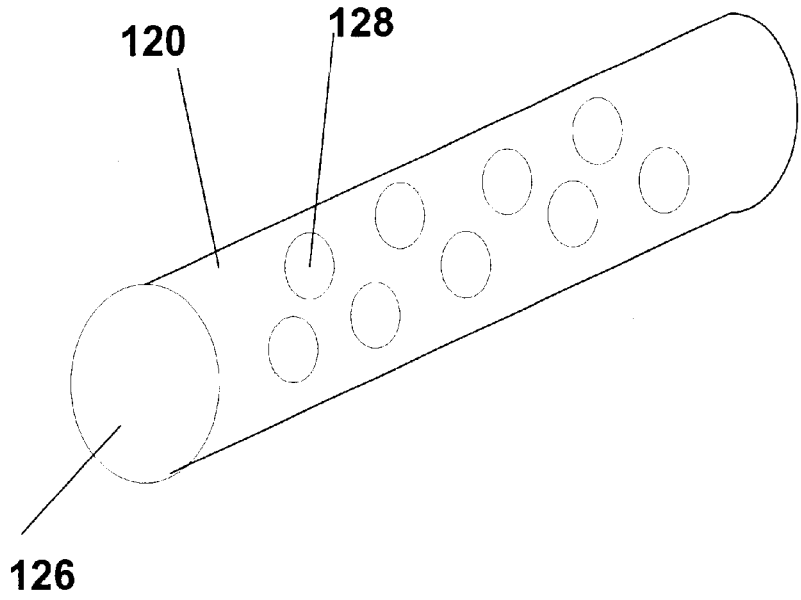
FIG. 4 is an isometric view of the inner housing of the sound absorber of FIG. 2.
Figure 5:
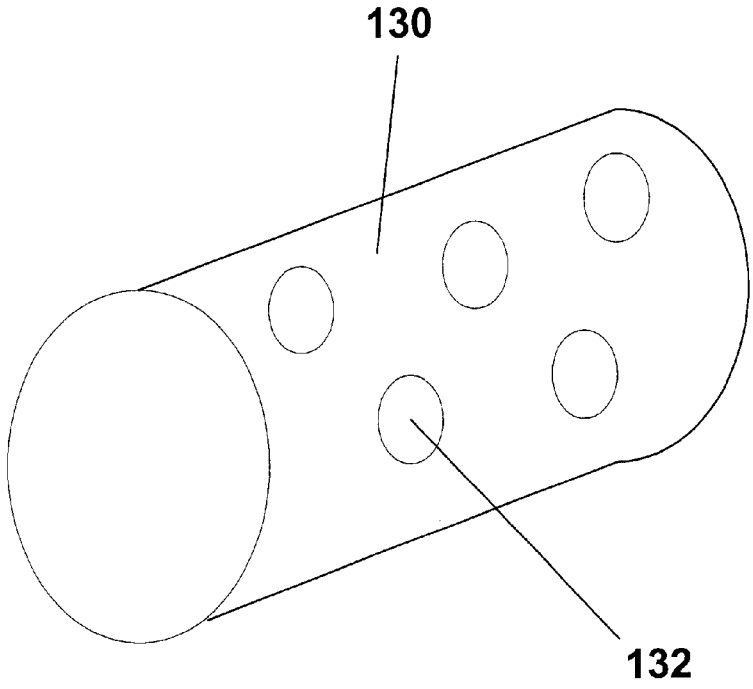
FIG. 5 is an isometric view of the partition,of the sound absorber of FIG. 2.
Figure 6A:
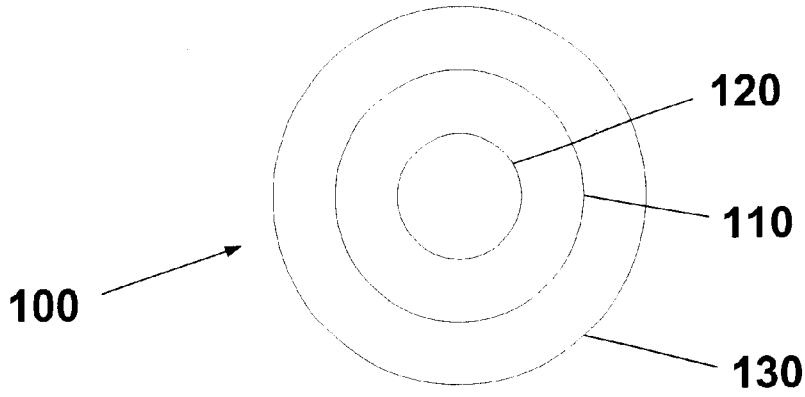
FIGS. 6A–B are cross-sectional end views of the sound absorber of FIG. 2 with the partition and with the partition removed, respectively.
Figure 6B:
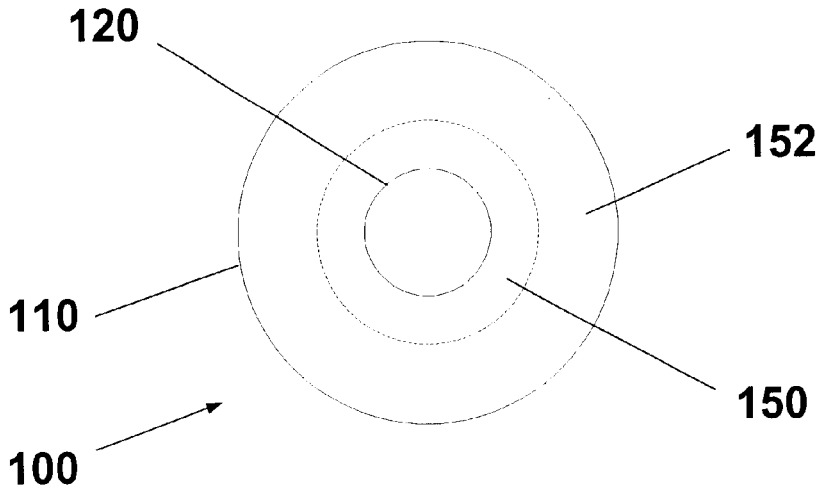

The inner housing 120 is porous, or perforated, to provide communication between the interior of passageway 126 and the annular spaced 112 between the two housings. In this embodiment, communication is provided by perforations 128 through inner housing 120. The space 112 between the housings is filled with a sound absorbing material, such as fiberglass wool. The space 112 is divided into two regions, or chambers, 140 and 142, at an interface 144. Each chamber 140, 142, is filled with a respective sound absorbing material 150, 152. The interface 144 may be defined by a partition 130 (as shown in FIGS. 3 and 5). The partition may be disposed in the housing only during the process of manufacturing the sound absorber 100 (as described below) and removed, or may left in the sound absorber. In the latter embodiment, partition 130 includes perforations 132 (as shown in FIG. 5) to provide communication between the chambers 140, 142.

In this embodiment, in which sound absorber 100 is a muffler for the exhaust system of an internal combustion engine, the gas flowing through the passage defined by inner housing 120 is hot (fore example on the order of 650–900°0 C.). Accordingly, sound absorbing material 150 (disposed in chamber 140) has a high resistance to thermal degradation. Sound absorbing material 152 can have lover resistance to thermal degradation since material 150 insulates material 152 from the high temperatures present within inner housing 120. For example, material 150 can provide a temperature gradient of approximately 10–15° C. per mm of thickness. Therefore, if material 150 has a thickness of 10 mm, the temperature at interface 144 would be approximately 100–150° C. lower than at the inner surface of first material 150.

Regardless of whether the partition 130 is removed the sound absorber will have two distinct layers of fitters. To minimize the thickness and cost of the inner layer, a thicker inner layer can be filled at a lower density. If the partition is removed, the outer fiber layer 152 will expand radially inwardly since it is filled at a higher density than the inner fiber layer 150.

The manufacturing of the sound absorber and operation of the direct fill apparatus is now explained with reference to FIG. 1. direct fill apparatus for filling a sound absorber is shown in FIG. 1. An example of the "direct fill" process is disclosed in U.S. Pat. No. 4,569,471 to Ingemansson et al. ("Ingemansson"), the disclosure of which is expressly incorporated by reference herein. The direct fill process uses compressed air in a nozzle to separate fiberglass strands into fibers and direct them into a chamber in the sound absorber.

Fiberglass wool in the form of substantially continuous fibers has greater resilience than short fibers. The continuous filling is less likely to be packed by intermittent exhaust gas pressure against the walls of the muffler or blown out through inner housing 120. By using the continuous filling, the noise dampening properties of the muffler are preserved for a longer period of time.

In the direct fill process, a multi-filament fiberglass strand is fed into an end of a nozzle and advanced through the nozzle with the aid of compressed air. The strand emerges from the nozzle as a continuous length of fiberglass wool. The wool is blown by the compressed air out of the nozzle and into a chamber in the muffler. A vacuum is drawn on the inner housing at the same time to facilitate the filling of the sound absorber.

While the direct fill apparatus shown in FIG. 1 has a single strand source and single nozzle, it is to be appreciated that multiple nozzles may be utilized for multiple strands. Also, the process may fill the chambers of the sound absorber with different strands of sound absorbing material simultaneously or sequentially.

The preferred manufacturing method is to use multiple nozzles for each strand and to fill the absorber with different strands sequentially. For reasons of simplicity only, the direct fill process will be explained for a single strand source and single nozzle.

The direct fill apparatus 200 feeds a fiberglass strand 212 from a package 210 through a nozzle system 240 to fill a sound absorber 100. The nozzle system 240 uses compressed air from a pressurized source (not shown) to force the strand from a nozzle 242 into a chamber of the sound absorber 100.

The air blown through the nozzle 242 moves the strand forward and separates and entangles the strand fibers so the strand emerges from the nozzle as wool with substantially continuous fibers. The wool is blown directly into the sound absorber and the air is drawn from the inner housing by a vacuum system 250.

Prior to the strand being inserted, the partition 130 is inserted between the inner and outer housings. The partition 130 may be inserted manually or automatically by attaching it to a portion of the nozzle system.

As the strand 212 is unwound from the package, it travels through a series of guides 214, 216 and a clamping means 220, and around a breaker roller 226 to a feeder 230. By deflecting the thread over the breaker roller 226, the cohesive layer between the fibers in the strand is broken and the fibers are separated. The feeder 230 guides the strand into the nozzle system 240.

The nozzle system includes a nozzle 242 and a plate 246 with an opening downstream of the nozzle. The sound absorber 100 is supported during the filling operation in a manner appreciated by the skilled artisan. The top end of the outer housing 110 is open and is positioned proximate the plate 246. The bottom end of the inner housing 120 is connected to a hose 254 that is part of a vacuum system 250, which draws air out of the inner housing 120 when the sound absorber is filled. The plate 246 is positioned to form a gap between the plate and a bracket of the nozzle system. Air flows through the gap and into the absorber to equalize pressure in the chambers.

The feeder 230 includes a pair of synchronously driven plastic-coated rollers 232, 234 of equal size and an intermediate freely rotatable metal roller 236 which is carried by pivot arms 238. The roller 236 is in a strand feeding position when it contacts the lower roller 234 with the thread pressed therebetween. Once the strand is fed into the nozzle, roller 236 is moved into contact with the upper roller 232 by a compressed air cylinder or other known mechanism. Roller 236 continues to roll when it is in contact with the upper roller 232.

The clamping means 220 includes a pair of non-rotatably mounted shafts 222, 224. The upper shaft 222 is biased downwardly by a spring into contact with the lower shaft 224. The lower shaft 224 can be moved relative to the upper shaft to clamp or release the strand. When the strand has been fed, arm 218 swings to its lower position to take up any slack in the thread as shown in FIG. 1. When the feeding operation begins again, the arm 218 is swung back to its upper position.

Once the inner and outer chambers 140, 142 have been filled, the partition may be removed.

The degree of expansion of the wool and the ultimate fill density is determined by factors such as the feed rate of the strand, the air speed, the vacuum level, the amount of air flowing through the nozzle, and the characteristics of the organic sizing on the strand. The feed rate is regulated so that it is lower than the speed at which the air tries to feed the strand from the nozzle, thereby maintaining the strand under tension. Initially, the air supplied to the nozzle is turned on before the feeder is started to tension the strand.

The degree to which the sound absorber is filled is determined by the vacuum in the absorber, which varies with the capacity of the vacuum 252. The amount of wool fed into the absorber can be determined by measuring the length of strand that has been fed through the feeder. This length can be calculated by counting the number of rotations of the roller 236 or by measuring the feeding time, if the rotational speed of the package is known. After the filling process is complete, the strand is cut by any known cutting means, such as a blade, placed immediately downstream of the nozzle.

When the absorber has been filled, it is moved to a station for attaching the end piece on the open end of the sound absorber. The end piece may be crimped, spun on, or welded to the ends of the absorber.

Since the wool has a tendency to expand when the vacuum is stopped, the absorber can be moved to the welding station while the vacuum is still drawing air. Alternatively, a cover plate is temporarily placed over the open end before the vacuum is stopped to prevent the wool from coming out before the end piece is placed on the absorber.

Figure 7:
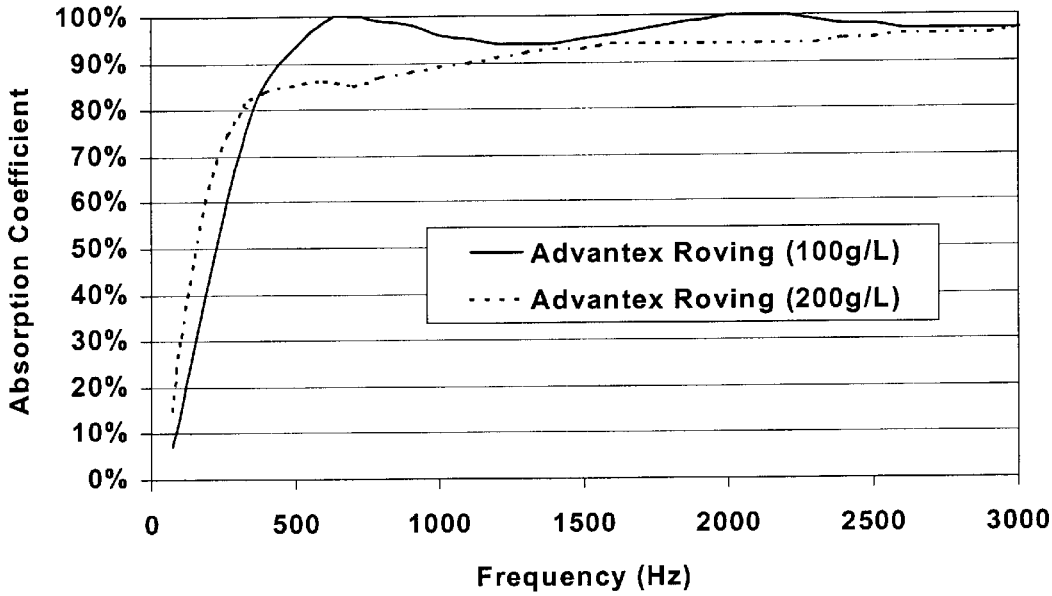
FIG. 7 is a chart showing the relationship between the fill density and the acoustic absorption properties over a range of frequencies.
Figure 8:
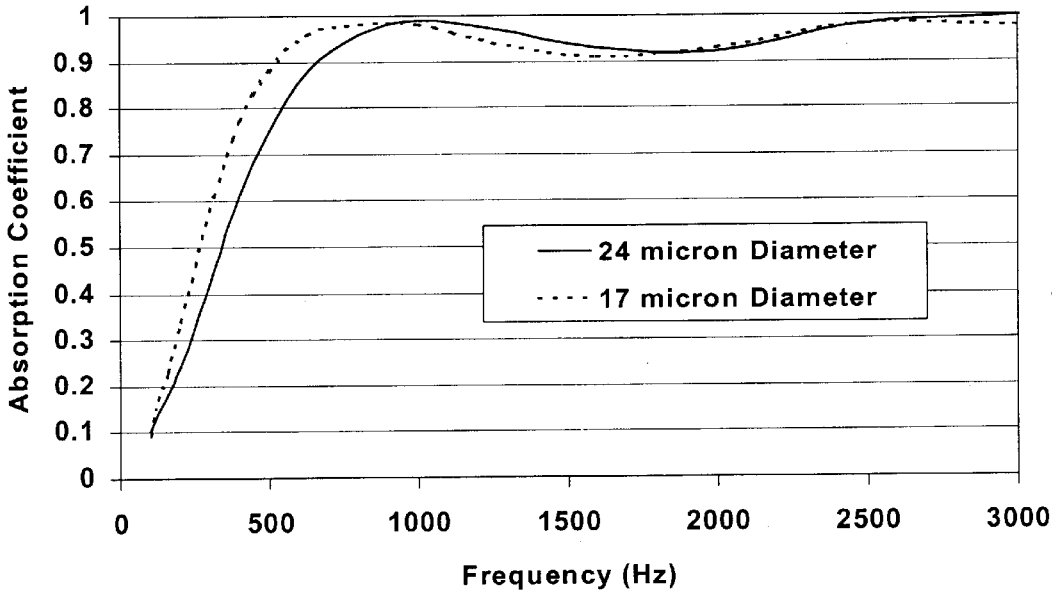
FIG. 8 is a chart showing the relationship between the fiber diameter and the acoustic absorption properties over a range of frequencies.

Both acoustic absorption and thermal insulation properties vary with fill density and fiber diameter of the absorber. For example, as shown in FIG. 7, at frequencies less than approximately 400 Hz, a higher density absorber will generally exhibit greater acoustic absorption than the same absorber filled at a lower density. However, at frequencies greater than approximately 400 Hz, a lower density absorber will generally exhibit greater acoustic absorption. Similarly, as shown in FIG. 8, changing the diameter of the fibers will exhibit the same crossover behavior. Smaller diameter fibers can incrementally increase the low frequency acoustic absorption but decrease the high frequency absorption as compared to larger diameter fibers. Furthermore, increasing the fill density (up to approximately 300 g/L) or decreasing the fiber diameter both decrease the thermal conductivity.

With the present invention, it is therefore possible to optimize both the acoustic and thermal properties of the entire system by adjusting the fill density and fiber diameter of each layer. As discussed above, if the materials 150, 152 are filled to different densities, and partition 130 is removed, the densities of the two materials will tend to equalize. In this manner, the inner layer can be designed to a smaller thickness than could be achieved with a given filling nozzle. For example, it can be difficult to fill a chamber with a thickness of less than 0.4 in. (1 cm) because the nozzle dimensions are too large. One solution is to adjust the thickness of the inner chamber 140 to an acceptable size and to fill the inner chamber 140 with a low density of sound absorbing material. When the partition 130 is removed, the inner and outer chambers 140, 142 equalize based on the densities of the sound absorbing material in each chamber, producing an inner chamber 140 with a thickness less than 0.4 in. (1 cm).

The components of the sound absorber are preferably metal, such as steel. Material 150 is preferably a glass fiber with a relatively high resistance to thermal degradation. Suitable glass fibers include S glass (Magnesium-Aluminum-Silicate glass), T glass, U glass, ECR glass, or any other composition with higher temperature resistance than material 152. Material 152 is preferably a glass fiber of relatively lower resistance to thermal degradations. Suitable glass fibers include A glass, Standard E glass (Boron-Calcium-Aluminum-Silicate glass), ECR glass, Advantex® (V (Calcium-Aluminum-Silicate glass), ZenTron™ glass, or any other composition with suitable strength to pass through, the filling process. Alternatively, both material 150 and material 152 may consist of the same composition, yet possess different diameters or be filled to different densities.

The following dimensions are provided for an exemplary sound absorber the principles of the invention:

inner diameter of outer housing=5 in. (120 mm)

outer diameter of partition=3.3 in. (83 mm)

inner diameter of partition=3.2 in. (80 mm)

outer diameter of inner housing=2 in. (50 mm)

diameter of partition perforations=0.25 in. (6 mm)

diameter of inner housing perforations=0.25 in. (6 mm)

diameter of sounding absorbing fibers=10–30 microns feed rate of strand through nozzle=985–1640 ft/min (300–500 m/min)

density of inner fiber layer=1,280–3,200 lb/ft$^3$ (80–200 g/L)

density of outer fiber layer=1,280–3,200 lb/ft$^3$ (80–200 g/L)

As the artisan will appreciate, the dimensions and feed rate identified above may be varied depending on the size of the sound absorber and the desired amount of sound absorption.

The artisan will also appreciate that there are many possible variations on the particular embodiment described above that would be consistent with the principles of the invention.

The shapes of the outer and inner housings may be other than the cylindrical shape shown in the Figures.

As discussed above, different strands of fibers may be simultaneously injected into their respective chambers using one or more nozzles for each strand. Also, a single nozzle may be used and rethreaded with the second fiber strand after the first has been inserted. During the filling process, the sound absorber may be oriented horizontally, or at any other angle, rather than vertically. The housing. also may be rotated during the filling operation.

The sound absorbing materials may be filled to the same density, rather than different densities.

The inner and outer chambers may be filled with a combination of different fibers. In other words, depending on the temperature profile along the inner housing, lower temperature fibers may be placed in the inner chamber along the inner housing at a point downstream at which the temperature is acceptable for its properties. Alternatively, a portion of the outer chamber may be filled with the higher temperature fibers.

It is also possible to use more than two different materials. For example, a highest temperature glass fiber could be used for the innermost layer of glass, an intermediate temperature glass fiber as an intermediate layer, and a lowest temperature glass fiber for an outer layer. Multiple partitions could be used to define three or more chambers into which to fill the various materials.

The direct fill process may be used without drawing a vacuum on the inner housing. In this case, air in the inner housing will be forced out of the downstream end of the inner housing.

Alternatively, the sound absorbing materials may be crystalline ceramic fibers, stainless steel fibers, or basalt fibers.

We claim:

1. A method of manufacturing a sound absorber including an outer housing and an inner housing defining a passageway, the method comprising the steps of:

inserting a partition between the outer housing and inner housing to define a first chamber between the partition and the outer housing and a second chamber between the partition and the inner housing;

injecting into the first chamber a first sound absorbing material;

injecting into the second chamber a second sound absorbing material different from the first sound absorbing material, said sound absorbing materials adapted to attenuate acoustic noise in a gas as it travels through the passageway; and removing said partition.

2. The method of claim 1, wherein the step of injecting the first sound absorbing material includes feeding compressed air and a continuous strand of said first sound absorbing material into a nozzle through which they are directed into the first chamber.

3. The method of claim 2, wherein the step of inserting the second sound absorbing material includes feeding compressed air and a continuous strand of said second sound absorbing material into a nozzle through which they are directed into the second chamber.

4. The method of claim 1, further comprising the step of:

injecting said second sound absorbing material into the first chamber.

5. The method of claim 1, further comprising the step of:

injecting said first sound absorbing material into the second chamber.

6. The method of claim 1, wherein said first sound absorbing material is injected into the first chamber to a different density than the density to which said second sound absorbing material is injected into the second chamber.

7. The method of claim 1, wherein the step of injecting a first sound absorbing material occurs simultaneously with the step of injecting a second sound absorbing material.

8. A sound absorber manufactured by the method of claim 1.

9. A sound absorber comprising:

an outer housing;

an inner housing defining a passageway, a portion of said inner housing disposed within said outer housing and defining with said outer housing a first chamber adjacent to said inner housing and a second chamber adjacent said first chamber;

a first sound absorbing material disposed in said first chamber; and a second sound absorbing material disposed in said second chamber, said first sound absorbing material being different from said second sound absorbing material, said sound absorbing materials being adapted to attenuate acoustic noise in a gas as it travels through said passageway, wherein said first sound absorbing material has a higher resistance to thermal degradation than said second sound absorbing material.

10. The sound absorber of claim 9, wherein said inner and outer housings are approximately cylindrical and said inner housing, first material, and second material are disposed concentrically within said outer housing.

11. A sound absorber comprising:

an outer housing;

an inner housing defining a passageway, a portion of said inner housing disposed within said outer housing and defining with said outer housing a first chamber adjacent to said inner housing and a second chamber adjacent said first chamber;

a first sound absorbing material disposed in said first chamber; and a second sound absorbing material disposed in said second chamber, said first sound absorbing material being different from sad second sound absorbing material, said sound absorbing materials being adapted to attenuate acoustic noise in a gas as it travels through said passageway, wherein said first sound absorbing material has a first density and said second sound absorbing material has a second density different from said first density.

12. The sound absorber of claim 9, further comprising a partition disposed within said housing and separating said first and second chambers.

13. The sound absorber of claim 9, wherein said sound absorbing materials are formed of glass fiber.

14. The sound absorber of claim 13 wherein said sound absorbing materials are selected from the group of A glass, S glass, T glass, U glass, ECR glass, Standard E glass, Advantex® glass, ZenTron™ glass, basalt glass, and basalt fibers.

15. The sound absorber of claim 14 wherein one of said sound absorbing materials is Calcium-Aluminum-Silicate glass.

16. The sound absorber of claim 9, wherein said sound absorbing materials are selected from the group of crystalline ceramic fibers and stainless steel fibers.

17. A sound absorber comprising:

an outer housing;

an inner housing defining a passageway, a portion of said inner housing disposed within said outer housing and defining with said outer housing a first chamber adjacent to said inner housing and a second chamber adjacent said first chamber;

a first sound absorbing material disposed in said first chamber, said first sound absorbing material including fibers having a first diameter; and a second sound absorbing material disposed in said second chamber, said second sound absorbing material including fibers having a second diameter, said second diameter being different from said first diameter, said sound absorbing materials being adapted to attenuate acoustic noise in a gas as it travels through said passageway.

18. The sound absorber of claim 17, wherein said first sound absorbing material has a first density and said second sound absorbing material has a second density different from said first density.

* * * * *

UNITED STATES PATENT AND TRADEMARK OFFICE

CERTIFICATE OF CORRECTION

PATENT NO. : 6,543,576 B1
DATED : April 8, 2003
INVENTOR(S) : Cofer

It is certified that error appears in the above-identified patent and that said Letters Patent is hereby corrected as shown below:

Column 9,
Line 38, "sad" should be -- said --

Signed and Sealed this

Sixteenth Day of September, 2003

JAMES E. ROGAN
*Director of the United States Patent and Trademark Office*